US005802834A

United States Patent [19]

Kallmann et al.

[11] Patent Number: 5,802,834

[45] Date of Patent: Sep. 8, 1998

[54] METHOD FOR THREADING YARNS OF TWO SUPPLY BOBBINS POSITIONED COAXIALLY ATOP ONE ANOTHER IN A TWO-FOR-ONE TWISTING SPINDLE THROUGH THE TWO-PART HOLLOW SPINDLE AXLE

[75] Inventors: Jürgen Kallmann, Kaarst; Helmut Heiser, Mönchengladbach; Jakob Nilges, Tönisvorst; Manfred Bermges, Nettetal, all of Germany

[73] Assignee: Palitex Project - Company GmbH, Krefeld, Germany

[21] Appl. No.: 583,420

[22] Filed: Jan. 5, 1996

[30] Foreign Application Priority Data

Jan. 7, 1995 [DE] Germany ..... 195 00 318.7

[51] Int. Cl.[6] ..... D01H 9/00

[52] U.S. Cl. ..... 57/279; 57/278; 57/281; 57/58.52; 57/57.7

[58] Field of Search ..... 57/279, 278, 281, 57/261, 266, 58.52, 58.7

[56] References Cited

U.S. PATENT DOCUMENTS

| | | | |
|---|---|---|---|
| 3,975,893 | 8/1976 | Franzen | 57/34 R |
| 4,120,142 | 10/1978 | Franzen | 57/34 R |
| 4,164,115 | 8/1979 | Franzen | 57/279 |
| 4,287,712 | 9/1981 | Franzen | 57/279 |
| 4,328,663 | 5/1982 | Kallman | 57/279 |
| 5,220,777 | 6/1993 | Badiali et al. | 57/279 |
| 5,291,729 | 3/1994 | Badiali et al. | 57/279 |
| 5,329,756 | 7/1994 | Meroni et al. | 57/269 |

FOREIGN PATENT DOCUMENTS

| | | |
|---|---|---|
| 0417850 | 3/1991 | European Pat. Off. . |
| 0494475 | 7/1992 | European Pat. Off. . |
| 0519539 | 12/1992 | European Pat. Off. . |
| 0528464 | 2/1993 | European Pat. Off. . |
| 1227367 | 10/1966 | Germany . |
| 1905049 | 9/1969 | Germany . |
| 1932941 | 1/1971 | Germany . |
| 2461796 | 11/1975 | Germany . |
| 2914656 | 10/1980 | Germany . |

*Primary Examiner*—Daniel P. Stodola
*Assistant Examiner*—Tina R. Taylor
*Attorney, Agent, or Firm*—Robert W. Becker & Associates

[57] ABSTRACT

In a method for threading yarns of two supply bobbins positioned coaxially one atop the other in a two-for-one twisting spindle through at two-part hollow spindle axle and a yarn guide channel of a yarn storage disk with a compressed-air operated injection threading device, a first supply bobbin is inserted into a two-for-one twisting spindle. A free yarn end of a second supply bobbin is threaded from above through a yarn guide tube of the second supply bobbin. The free yarn end of the second supply bobbin and the free yarn end of the first supply bobbin are combined and guided into an inlet of a yarn guide tube of the first supply bobbin. The compressed-air operated threading device is actuated and the second supply bobbin is then inserted into the two-for-one twisting spindle on top of the first supply bobbin.

8 Claims, 2 Drawing Sheets

METHOD FOR THREADING YARNS OF TWO SUPPLY BOBBINS POSITIONED COAXIALLY ATOP ONE ANOTHER IN A TWO-FOR-ONE TWISTING SPINDLE THROUGH THE TWO-PART HOLLOW SPINDLE AXLE

BACKGROUND THE INVENTION

In addition to two-for-one twisting spindles in which the two individual yarns removed from the supply bobbins are introduced together into the upper end of the yarn guide tube, for the double positioning of two supply bobbins there are also two-for-one twisting spindles known which are provided with two spaced apart yarn guide tubes positioned one atop the other, in which the two yarns individually removed from the supply bobbins are separately introduced above the respective supply bobbin into the respective yarn guide tube (see German application 12 27 367).

In German published document 19 32 941 a two-for-one twisting spindle is disclosed which for the double placement of two supply bobbins is provided with two spaced-apart yarn guide tubes positioned one atop the other. The two individual yarns removed from the two supply bobbins are introduced separate from one another above the corresponding supply bobbin into the respective yarn guide tube. In order to allow for a stepped braking of the respective individual yarns, at the lower end of the upper yarn guide tube, which is provided with a yarn brake for the yarn of the upper supply bobbin, a further spring-loaded braking element is provided for the yarn removed from the lower supply bobbin. During operation of the two-for-one twisting spindle the spring-loaded braking element is forced with a defined braking force against the upper end of the lower yarn guide tube. This published document does not provide any information with respect to the manner in which the yarn is threaded and especially does not provide any information with respect to a pneumatic yarn threading.

In German Patent 24 61 796 a two-for-one twisting spindle is described that is provided with a compressed-air threading device positioned in the area of the hollow spindle axle with which the yarn is sucked by an injection effect into the hollow spindle axle and is transported by the compressed air stream through the yarn guide channel of the yarn storage disk. In order to allow for a corresponding pneumatic threading in a two-for-one twisting spindle that is supplied with a yarn brake, it is known according to German Patent 29 14 656 to design the yarn brake such that the compressed air guided into the pneumatic threading device is simultaneously used to open, respectively, vent the yarn brake in order to form a free continuous threading path.

In a two-for-one twisting spindle with double placement of two supply bobbins, from which the two individual yarns are separately removed and introduced into the correspondingly arranged yarn guide openings in the vicinity of the hollow spindle axle, the pneumatic threading could be performed with a threading device according to German Patent 24 61 796 in the following manner.

First, the spool carrier including the protective pot and carrying the lower supply bobbin is inserted into the two-for-one twisting spindle, and the yarn is then threaded by placing the free yarn end removed from this lower supply bobbin on the associated inlet opening of the yarn guide tube and by actuating the pneumatic threading device. The yarn additionally passes through a so-called yarn wing which affects the removal of the yarn from the supply bobbin in an advantageous manner.

Subsequently, the upper spool carrier with the upper supply bobbin is placed onto the spindle whereby in the center of the hub of the upper spool carrier a yarn inlet tube is provided which projects past the upper edge of the bobbin sleeve by a certain amount. On this inlet tube a further yarn wing is concentrically positioned in order to improve removal of the yarn from the supply bobbin to be removed from the upper supply bobbin. The uppermost point of this inlet tube is simultaneously also the inlet opening for the single yarn of the upper supply bobbin. If now the yarn of the upper supply bobbin, without taking into consideration the already threaded yarn of the lower supply bobbin, were pneumatically threaded as known, the yarn of the lower supply bobbin would be further removed by the injector air stream so that the yarn wing of the lower supply bobbin would be forced into rotation. After completion of the threading of the yarn coming from the upper supply bobbin, the yarn wing of the lower supply bobbin would still follow due to its mass inertia. This would result in further yarn being removed which would result in less twisting or entanglement of the yarns within the yarn wing eye. Upon activation of the twisting spindle, this would automatically result in yarn breakage.

For a two-for-one twisting spindle with double placement of two supply bobbins, the individual yarns of which are introduced into the hollow spindle axis through separately arranged thread inlet openings, it is known from European application 0 528 464 to supply the individual yarn removed from the lower supply bobbin inserted into the spindle to a compressed air threading device positioned externally to the two-for-one twisting spindle, onto which subsequently the upper supply bobbin is placed in order to thread the yarn coming from the lower supply bobbin centrally through the second upper supply bobbin by activating the threaded device. Subsequently, the second supply bobbin is inserted above the first supply bobbin into the two-for-one twisting spindle. Then, the free yarn end removed from the upper supply bobbin is placed onto the upper end of the yarn guide tube of the upper supply bobbin and is threaded together with the other free yarn end, removed from the lower supply bobbin and positioned at the same location, with a second pneumatic threading device through the entire system. The guide tube of the upper supply bobbin is movable in the downward direction in order to, on the one hand, activate the first injector for threading the yarn coming from the lower supply bobbin through the upper yarn inlet tube and, on the other hand, during the simultaneous threading of both yarns with the second threading device, to open mechanically a yarn brake positioned in the area of the lower supply bobbin. In addition to the need of having two pneumatic threading devices within the area of each individual spindle, resulting in a great mechanical expenditure, this method of threading is also very complicated.

Similarly, the function of the threading device for the system disclosed in European patent application 0 519 539 in which the yarn coming from the lower supply bobbin is first positioned exterior to the two-for-one twisting spindle before subsequently the upper supply bobbin is inserted into the two-for-one twisting spindle is fairly complicated. Subsequently, the single yarn coming from the upper supply bobbin is threaded with a pneumatically operated threading device positioned at the upper end of the upper yarn inlet tube through the entire system. The yarn removed from the upper supply bobbin is threaded in the conventional manner to the upper side of the spindle where it is gripped by the operator. Then the upper supply bobbin must be removed from the spindle. The two single yarns removed from the upper and lower supply bobbins are connected by tying a knot, and the upper supply bobbin is again introduced into the spindle. By again placing the pneumatic threading device onto the upper yarn inlet tube, the individual yarn coming from the lower supply bobbin is subsequently also threaded into the lower yarn guide tube. This yarn threading process is also difficult and often plagued by malfunctions.

It is therefore an object of the present invention to provide a threading method which is much simpler than the methods known from the prior art.

SUMMARY OF THE INVENTION

The inventive method for threading yarns of two supply bobbins, positioned coaxially one atop the other in a two-for-one twisting spindle, through a two-part hollow spindle axle and a yarn guide channel of the yarn storage disk with a compressed-air operated injection threading device according to the present invention is primarily characterized by the following steps:

a) Inserting a first supply bobbin into a two-for-one twisting spindle;

b) Threading a free yarn end of a second supply bobbin from the top through a yarn guide tube of the second supply bobbin;

c) Combining the free yarn end of the second supply bobbin with a free yarn end of the first supply bobbin;

d) Guiding the free yarn ends of the first and second supply bobbins into an inlet of a yarn guide tube of the first supply bobbin 7:

e) Actuating a compressed-air operated threading device; and f) Inserting the second supply bobbin into the two-for-one twisting spindle on top of the first supply bobbin.

Preferably, the method further includes the step of securing the first yarn end of the first supply bobbin at the upper area of the two-for-one twisting spindle before carrying out step c).

Preferably, the method further includes before step b) the following step:

Placing the second supply bobbin together with a protective pot enclosing the second supply bobbin onto an auxiliary threading device comprising a hollow pin with axial slot from which a radial slot extends.

The present invention is also concerned with a second method for threading yarns of two supply bobbins to be positioned coaxially one atop the other in a two-for-one twisting spindle. The individual yarn of each one of the supply bobbins is introduced into an inlet of the yarn guide tube of each one of the supply bobbins which inlet is arranged above the respective supply bobbin. The hollow spindle axle section associated with the lower supply bobbin is provided with a compressed air operated threading device with which the free yarn ends placed into the inlet of the yarn guide tube of the lower supply bobbin are sucked by an injection effect into the hollow spindle axle and guided through the yarn guide channel of the yarn storage disk by the compressed air stream. This second inventive method is primarily characterized by the following steps:

a) Inserting a first supply bobbin into a two-for-one twisting spindle;

b) Placing a second supply bobbin onto a hollow pin of an auxiliary threading device, the hollow pin comprising an axial slot from which a radial slot extends, wherein the auxiliary threading device is connected to an upper end of the two-for-one twisting spindle;

c) Removing a free yarn end from the second supply bobbin;

d) Threading the free yarn end of the second supply bobbin from the top into a yarn guide tube of the second supply bobbin and the hollow pin;

e) Removing a free yarn end of the first supply bobbin;

f) Combining the free yarn end of the second supply bobbin with the free yarn end of the first supply bobbin;

g) Guiding the free yarn ends of the first and second supply bobbins into an inlet of a yarn guide tube of the first supply bobbin;

h) Actuating a compressed-air operated threading device for threading the free ends of the first and second supply bobbins through a yarn guide channel of a yarn storage disk;

i) Removing the second supply bobbin from the auxiliary threading device; and j) Inserting the second supply bobbin into the two-for-one twisting spindle atop the first supply bobbin.

The method may further include the step of securing the free yarn end of the first supply bobbin at the upper area of the two-for-one twisting spindle before carrying out step f).

The present invention also relates to a device for threading a free yarn end of a supply bobbin, inserted into a protective pot comprising a yarn guide tube, for a two-for-one twisting spindle. The device comprises a holder for the protective pot and the supply bobbin, the holder connected to an upper part of the two-for-one twisting spindle. The holder comprises a hollow pin with a continuous axial slot, a lower support surface for the supply bobbin and a radial slot positioned in the vicinity of the lower support surface and connected to the axial slot.

Preferably, the device further comprises a compressed-air operated injection threading device.

Advantageously, the device further comprises a guide rail to which the holder is slidably connected. The guide rail is connected to a longitudinal side of a two-for-one twisting machine comprising a plurality of two-for-one twisting spindles. The guide rail comprises a clamping element at each one of the two-for-one twisting spindles, the clamping element serving to secure the free yarn end of a supply bobbin placed first into the two-for-one twisting spindles.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENT

The present invention will now be described in detail with the aid of a specific embodiment utilizing FIGS. 1 and 2.

Figure 1:
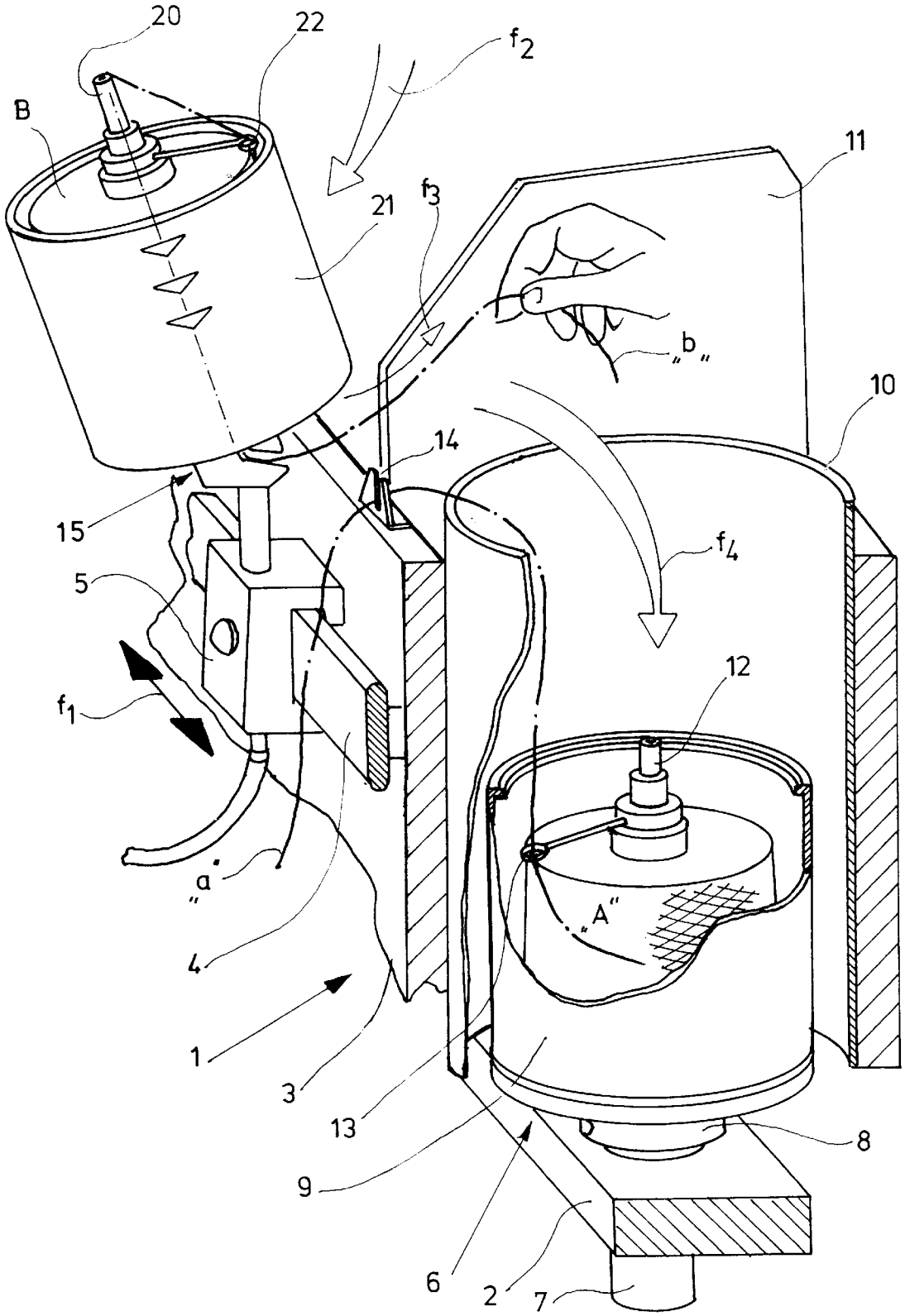
FIGS. 1 and 2 show partly in section side views of a two-for-one twisting spindle during the course of two subsequently performed method steps for performing the inventive method.
Figure 2:
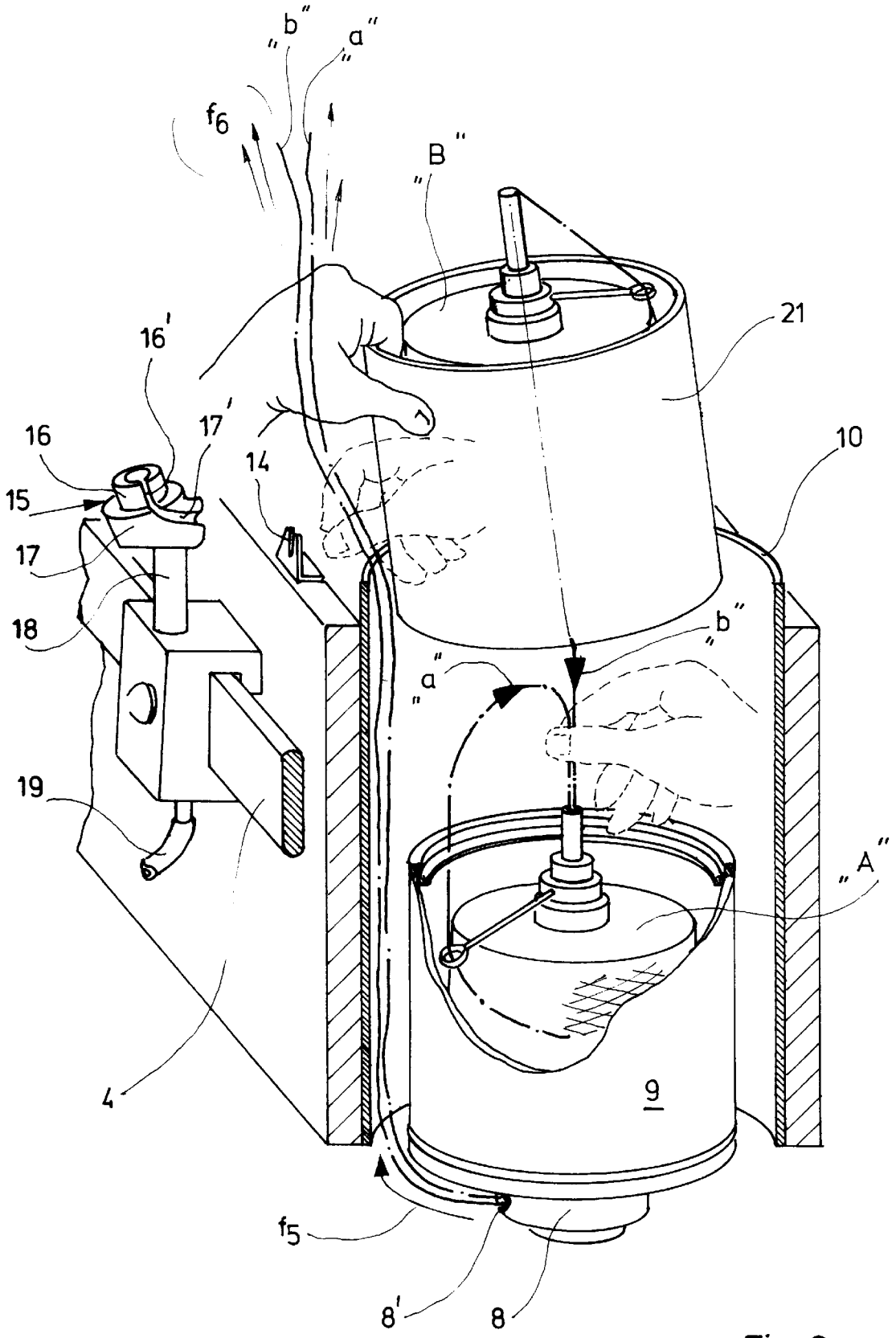

FIG. 1 schematically represents a two-for-one twisting spindle comprising a spindle frame 2 and a machine front wall 3 to which a guide rail 4 is connected for moving the carriage 5 in the direction of double arrow f1. At the spindle frame 2 a plurality of two-for-one twisting spindles 6 are supported adjacent to one another. In FIGS. 1 and 2 only one spindle is shown. Each individual spindle 6 comprises a whorl 7, a yarn storage disk 8, and a protective pot 9 which is secured against rotation with non-represented magnets. Each spindle comprises furthermore a balloon limiter 10. Between adjacently arranged spindle a partition 11 is provided.

The protective pot 9 has coordinated therewith in a conventional manner a yarn inlet tube 12.

For supplying each individual two-for-one twisting spindle 6 with yarn, a first supply bobbin A, optionally together with the protective pot 9, is inserted into the twisting spindle. The free yarn end a removed from the first supply bobbin A is guided through the yarn wing eye 13 and preferably secured at the yarn clamping element 14 which is arranged is arranged in the area of the upper balloon limiter edge at the forward side of the machine.

To the carriage 5 an auxiliary threading device, preferably in the form of a holder 15 for the protective pot and the supply bobbin is connected. This holder 15 comprises a hollow pin 16 provided with a continuous axial slot 16' to which is connected, in the area of the eye bobbin support surface 17, a substantially radially oriented slot 17'. The support surface 17 is connected to the upper end of the hollow body 18 which, in a manner not represented in the drawings, also comprises a threading device operated with compressed air and acting injector-like. The threading device is supplied with compressed air via a compressed air connector 19.

A second supply bobbin B, together with the protective pot 21 enclosing the bobbin and comprising a yarn inlet tube 20, is placed in the direction of arrow f2 onto the hollow pin 16 of the holder 15 for the protective pot and the supply bobbin. This holder 15 is connected in a displaceable manner to the guide rail 4 and has been moved into the area of the two-for-one twisting spindle 6 which is to be serviced.

The yarn removed from the supply bobbin B and threaded through the yarn wing eye 22 is subsequently threaded by activating the threading device (not represented in the drawing), which is operated by the compressed medium, through the yarn guide tube 20 and the hollow pin 16 so that the free yarn end b exiting in the direction of arrow f3 can be gripped manually by the operator. This yarn end b is combined with the yarn end a, which is secured in the area of the clamping element 14, and both yarn ends a and b are then placed onto the inlet opening of the yarn guide tube 12 provided at the lower supply bobbin A. A known threading device, which is positioned in the area of the hollow spindle axle of the lower supply bobbin and is compressed-air activated, is then actuated with compressed air so that the two free yarn ends are threaded in the manner shown in FIG. 2 through the lower spindle hollow axle section coordinated with the lower supply bobbin A and threaded into the yarn guide channel 8' and subsequently into the gap between the lower protective pot 9 and the balloon limiter 10 in the upward direction, as is indicated in FIG. 2 by arrows f5 and f6. The yarn ends which are threaded in this manner are subsequently tensioned, while the upper supply bobbin B together with the protective pot 21 is removed from the holder 15 for the protective pot and the supply bobbin and is then lowered in the direction of arrow f4 (in the manner represented in FIG. 2) from above onto the upper edge of the lower protective pot 9.

The axial and radial slots 16' and 17' allow for guiding the yarn b away from the holder 15 for the protective pot and the supply bobbin.

The present invention is, of course, in no way restricted to the specific disclosure of the specification and drawings, but also encompasses any modifications within the scope of the appended claims.

What we claim is:

1. A method for pneumatically threading yarns of two supply bobbins, positioned coaxially one atop the other in a two-for-one twisting spindle, through a two-part hollow spindle axle and a yarn guide channel of the yarn storage disk with a compressed-air operated injection threading device, said method comprising the steps of:

a) inserting a first supply bobbin into a two-for-one twisting spindle;

b) threading a free yarn end of a second supply bobbin from above only through a yarn guide tube of the second supply bobbin;

c) thereafter, combining the free yarn end of the second supply bobbin with a free yarn end of the first supply bobbin;

d) thereafter, guiding the combined free yarn ends of step c) into an inlet of a yarn guide tube of the first supply bobbin;

e) actuating a compressed-air operated threading device for threading the free yarn ends through the yarn guide tube of the first supply bobbin and the yarn guide channel of the yarn storage disk; and f) inserting the second supply bobbin into the two-for-one twisting spindle on top of the first supply bobbin.

2. A method according to claim 1, further including the step of securing the free yarn end of the first supply bobbin at the upper area of the two-for-one twisting spindle before carrying out the step c).

3. A method for pneumatically threading yarns of two supply bobbins, to be positioned coaxially one atop the other in a two-for-one twisting spindle, wherein the individual yarn of each one of the supply bobbins is introduced into an inlet of a yarn guide tube of each one of the supply bobbins, which inlet is arranged above the respective supply bobbin, wherein the hollow spindle axle section associated with the lower supply bobbin is provided with a compressed air operated threading device with which the free yarn ends placed into the inlet of the yarn guide tube of the lower supply bobbin are sucked by an injection effect into the hollow spindle axle and guided through the yarn guide channel of the yarn storage disk by the compressed air stream, said method comprising the steps of:

a) inserting a first supply bobbin into a two-for-one twisting spindle;

b) placing a second supply bobbin onto a hollow pin of an auxiliary threading device, the hollow pin comprising a cylindrical wall having an axial slot and a support surface connected to said cylindrical wall, the support surface having a radial slot as an extension of the axial slot, wherein the auxiliary threading device is connected to an upper end of the two-for-one twisting spindle;

c) removing a free yarn end from the second supply bobbin;

d) threading the free yarn end of the second supply bobbin from above into a yarn guide tube of the second supply bobbin and the hollow pin only;

e) removing a free yarn end of the first supply bobbin;

f) thereafter, combining the free yarn end of the second supply bobbin with the free yarn end of the first supply bobbin;

g) thereafter, guiding the combined free yarn ends of step f) into an inlet of a yarn guide tube of the first supply bobbin;

h) actuating a compressed-air operated threading device for threading the free yarn ends of the first and second supply bobbins through a yarn guide channel of a yarn storage disk;

i) removing the second supply bobbin from the auxiliary threading device; and j) inserting the second supply bobbin into the two-for-one twisting spindle atop the first supply bobbin.

4. A method according to claim 3, further including the step of securing the free yarn end of the first supply bobbin at the upper area of the two-for-one twisting spindle before carrying out step f).

5. A device for pneumatically threading a free yarn end of a supply bobbin, the supply bobbin inserted into a protective pot comprising a yarn guide tube, for a two-for-one twisting spindle, said device comprising:

a holder for a protective pot and a supply bobbin, said holder connected to an upper part of a two-for-one twisting spindle;

said holder comprising a hollow pin having a continuous axial slot;

said holder having a lower support surface connected to said hollow pin for supporting a supply bobbin;

said lower support surface having a radial slot connected to said axial slot.

6. A device according to claim 5, further comprising a compressed-air operated injection threading device.

7. A device according to claim 5, further comprising a guide rail to which said holder is slidably connected, said guide rail connected to a longitudinal side of a two-for-one twisting machine comprising a plurality of two-for-one twisting spindles, wherein said guide rail comprises a clamping element at each one of the two-for-one twisting spindles, said clamping element serving to secure the free yarn end of a supply bobbin placed first into the two-for-one twisting spindles.

8. A method for pneumatically threading yarns of two supply bobbins, positioned coaxially one atop the other in a two-for-one twisting spindle, through a two-part hollow spindle axle and a yarn guide channel of the yarn storage disk with a compressed-air operated injection threading device, said method comprising the steps of:

a) inserting a first supply bobbin into a two-for-one twisting spindle;

b) placing a second supply bobbin together with a protective pot enclosing the second supply bobbin onto an auxiliary threading device comprising a hollow pin comprising a cylindrical wall having an axial slot and a support surface connected to said cylindrical wall, the support surface having a radial slot as an extension of the axial slot;

c) threading a free yarn end of the second supply bobbin from above through a yarn guide tube of the second supply bobbin;

d) combining the free yarn end of the second supply bobbin with a free yarn end of the first supply bobbin;

e) guiding the free yarn ends of the first and second supply bobbins into an inlet of a yarn guide tube of the first supply bobbin;

f) actuating a compressed-air operated threading device for threading the free yarn ends through the yarn guide tube of the first supply bobbin and the yarn guide channel of the yarn storage disk; and g) inserting the second supply bobbin into the two-for-one twisting spindle on top of the first supply bobbin.

* * * * *